US008096249B2

(12) United States Patent
Tajima et al.

(10) Patent No.: US 8,096,249 B2
(45) Date of Patent: Jan. 17, 2012

(54) ROTARY HOOK DRIVE DEVICE AND MULTI-HEAD SEWING MACHINE

(75) Inventors: Ikuo Tajima, Nagoya (JP); Yoichi Mizuguchi, Iwakura (JP); Taichi Fukushima, Kasugai (JP)

(73) Assignee: Tokai Kogyo Mishin Kabushiki Kaisha (JP)

( * ) Notice: Subject to any disclaimer, the term of this patent is extended or adjusted under 35 U.S.C. 154(b) by 306 days.

(21) Appl. No.: 12/488,243

(22) Filed: Jun. 19, 2009

(65) Prior Publication Data

US 2009/0314192 A1 Dec. 24, 2009

(30) Foreign Application Priority Data

Jun. 20, 2008 (JP) ..... 2008-161718

(51) Int. Cl.
*D05B 57/14* (2006.01)

(52) U.S. Cl. ..... 112/181

(58) Field of Classification Search ..... 112/163, 112/181, 189, 194, 289, 462, 465, 466, 463, 112/459, 460

See application file for complete search history.

(56) References Cited

U.S. PATENT DOCUMENTS 7,461,606 B2 * 12/2008 Ota et al. ..... 112/462
7,603,957 B2 * 10/2009 Shiraishi ..... 112/298
7,677,187 B2 * 3/2010 Terao et al. ..... 112/466
7,891,307 B2 * 2/2011 Sakuma et al. ..... 112/475.17

* cited by examiner

*Primary Examiner* — Tejash Patel
(74) *Attorney, Agent, or Firm* — Rossi, Kimms & McDowell LLP

(57) ABSTRACT

Rotary hook drive device for a sewing machine includes: a rotary hook rotatably provided on a rotary hook support; a cylindrical grooved cam provided on a drive shaft drivable to rotate in one direction; a cam follower engaged in a cam groove of the cylindrical grooved cam and capable of making reciprocative movement about a support shaft in response to rotation of the cylindrical grooved cam; and a transmission mechanism that transmits the reciprocative movement of the cam follower to the rotary hook to cause the rotary hook to make reciprocative pivoting movement. Such arrangements can prevent deviation in driving timing of the rotary hook and simplify the construction of the rotary hook drive device.

4 Claims, 6 Drawing Sheets

ROTARY HOOK DRIVE DEVICE AND MULTI-HEAD SEWING MACHINE

BACKGROUND

The present invention relates generally to rotary hook drive devices for sewing machines including a pivoting-type loop catcher called a "semi rotary hook", and particularly to multi-head sewing machines (embroidery sewing machines and other types of sewing machines) including a plurality of sewing heads and a plurality of hook drive devices provided in corresponding relation to the sewing heads.

The rotary hooks, which are means for catching a lower thread in a sewing machine, come in two major types: a full rotary type; and a semi rotary type. The semi rotary (type) hook is used, for example, when a thick sewing work piece is to be sewn. Japanese Patent Application Laid-open Publication No. 2001-104671 (hereinafter referred to as "patent literature 1") discloses a semi rotary hook drive mechanism, where a single common drive shaft is rotatably supported by individual hook support members. The drive shaft is connected in such a manner that its driving force is transmitted to the semi rotary hooks within the individual hook support members. The drive shaft is also connected to a main shaft of the sewing machine via a drive conversion mechanism, so that it reciprocatively pivots within a predetermined angular range as the main shaft of the sewing machine pivots in one direction. Such reciprocating pivotal movement of the drive shaft causes respective rotary hook shafts to reciprocatively pivot so that the semi rotary hooks pivot.

According to the disclosure of patent literature 1, the drive shaft provided in common to the individual hook support members is caused to reciprocate pivotal movement in forward and reverse directions. Therefore, in a case where many machine heads are employed and thus the drive shaft has a large length, and when the direction of the pivotal movement of the drive shaft is changed, great torsion would be produced in a free end portion, remote from the drive conversion mechanism, of the drive shaft due to rotational inertia; consequently, the free end portion would pivot through more than a predetermined angle and thus the semi rotary hooks would pivot more than necessary. As a consequence, the semi rotary hooks would be driven at improper timing deviated from required timing, which may not only cause breakage of threads but also cause the semi rotary hooks and sewing needles to contact with each other so that they are undesirably impaired.

Korean Utility Model Registration No. 20-405210 (hereinafter referred to as "patent literature 2") discloses a semi rotary hook drive mechanism, which rotates a rotary hook drive shaft in one direction so as to pivot semi rotary hooks via drive conversion mechanisms provided in respective rotary hook support members. The semi rotary hook drive mechanism employed in a first embodiment disclosed in patent literature 2 is constructed in such a manner that the driving force of the drive shaft is transmitted via gear connections to a crank mechanism. The thus-transmitted driving force is converted by the crank mechanism into reciprocative pivoting movement (force), which is then transmitted via gear connections to rotary hook shafts to pivot the semi rotary hooks. Because the drive shaft is rotated in one direction in the disclosed semi rotary hook drive mechanism, the torsion produced due to rotational inertia can be reduced and deviation of the driving timing of the rotary hooks can also be reduced, even where many heads are employed. As a result, stable sewing can be achieved. However, because the drive conversion mechanism, including the crank mechanism and two sets of the gear connections, has an increased number of necessary components, which would increase the cost and size of the semi rotary hook drive mechanism and impose a great load on the drive shaft due to the increased size.

As set forth above, in the semi rotary hook drive mechanism disclosed in patent literature 1, where the drive shaft reciprocatively pivots in the forward and reverse directions, great torsion is produced in the free end portion, remote from the drive conversion mechanism, of the drive shaft, and thus, the semi rotary hooks would pivot more than necessary. Consequently, deviation in the driving timing (and hence untimely driving) of the semi rotary hooks would occur, which may not only prevent stable sewing but also cause damage or impairment of the semi rotary hooks and sewing needles. Further, the semi rotary hook drive mechanism disclosed in patent literature 2, where the drive shaft is rotated in one direction, would require an increased number of necessary components and impose a great load on the drive shaft although it can reduce deviation in the driving timing of the semi rotary hooks.

SUMMARY OF THE INVENTION

In view of the foregoing, it is an object of the present invention to provide an improved rotary hook drive device which can prevent deviation in the driving timing of the semi rotary hooks and can be simplified in construction, as well as a multi-head sewing machine provided with such an improved rotary hook drive device.

In order to accomplish the above-mentioned object, the present invention provides an improved rotary hook drive device for a sewing machine, which comprises: a rotary hook rotatably provided on a rotary hook support; a cylindrical grooved cam provided on a drive shaft drivable to rotate in one direction; a cam follower engaged in a cam groove of the cylindrical grooved cam and capable of making reciprocative movement about a support shaft in response to rotation of the cylindrical grooved cam; and a transmission mechanism that transmits the reciprocative movement of the cam follower to the rotary hook to cause the rotary hook to make reciprocative pivoting movement.

In one embodiment, the transmission mechanism includes: a driving gear reciprocatively pivotable about the support shaft; and a driven gear provided on a rotary hook shaft, supporting the rotary hook, and held in meshing engagement with the driving gear. In another embodiment, the transmission mechanism comprises a link mechanism that amplifies the reciprocative movement of the cam follower and transmits the amplified reciprocative movement to a rotary hook shaft of the rotary hook.

According to another aspect of the present invention, there is provided an improved multi-head sewing machine including: a plurality of sewing heads; and a plurality of rotary hooks provided in corresponding relation to the sewing heads and pivotably supported by respective rotary hook supports, the multi-head sewing machine comprising: a plurality of transmission mechanisms provided in corresponding relation to the plurality of rotary hooks; a cylindrical grooved cam provided on a drive shaft drivable to rotate in one direction; a cam follower engaged in a cam groove of the cylindrical grooved cam and capable of making reciprocative movement about a support shaft in response to rotation of the cylindrical grooved cam; and an interlocking mechanism that distributes the reciprocative movement of the cam follower to the plurality of transmission mechanisms corresponding to the plurality of rotary hooks. Here, the reciprocative movement of the cam follower is distributed to the plurality of rotary hooks, via the interlocking mechanism and the transmission mechanisms, to thereby cause the plurality of rotary hooks to make reciprocative movement.

According to the present invention, where the drive shaft is driven to rotate in one direction, stable sewing can be performed with minimized deviation in the driving timing of semi rotary hooks in a multi-head sewing machine. Further, because the rotary hook drive device of the present invention is of a simple construction comprising the cylindrical grooved cam and cam follower, or a set of the gears, the present invention can not only reduce the number of necessary component parts and hence necessary cost, but also reduce the size of the rotary hook drive device (inertial load on a power transmission system of the drive device) and hence the load on the drive shaft. As a result, the present invention allows the sewing machine to operate at increased speed, and permits an increase in the number of the sewing heads if the rotary hook drive device is applied to a multi-head sewing machine.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF DRAWINGS

For better understanding of the object and other features of the present invention, its preferred embodiments will be described hereinbelow in greater detail with reference to the accompanying drawings, in which.

DETAILED DESCRIPTION

First Embodiment

Figure 1:
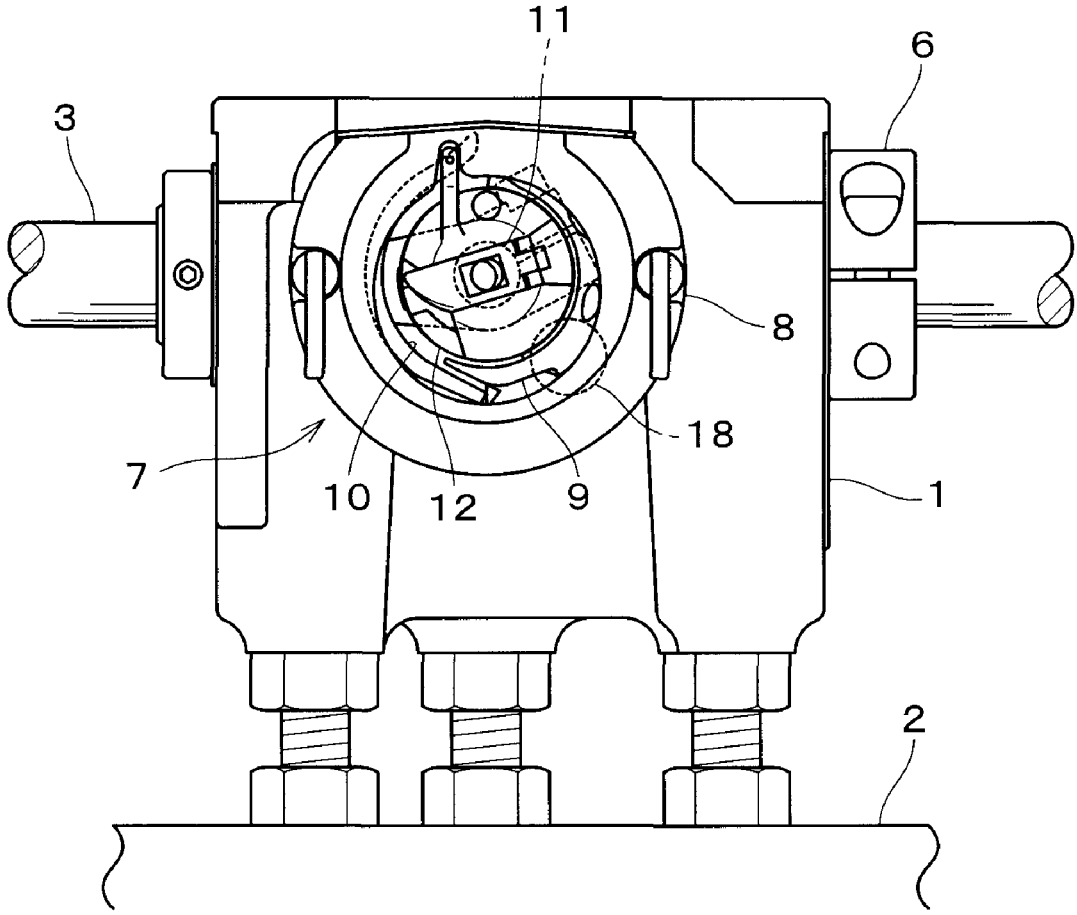
FIG. 1 is a front view of a rotary hook drive device for a sewing machine according to a first embodiment of the present invention.
Figure 2:
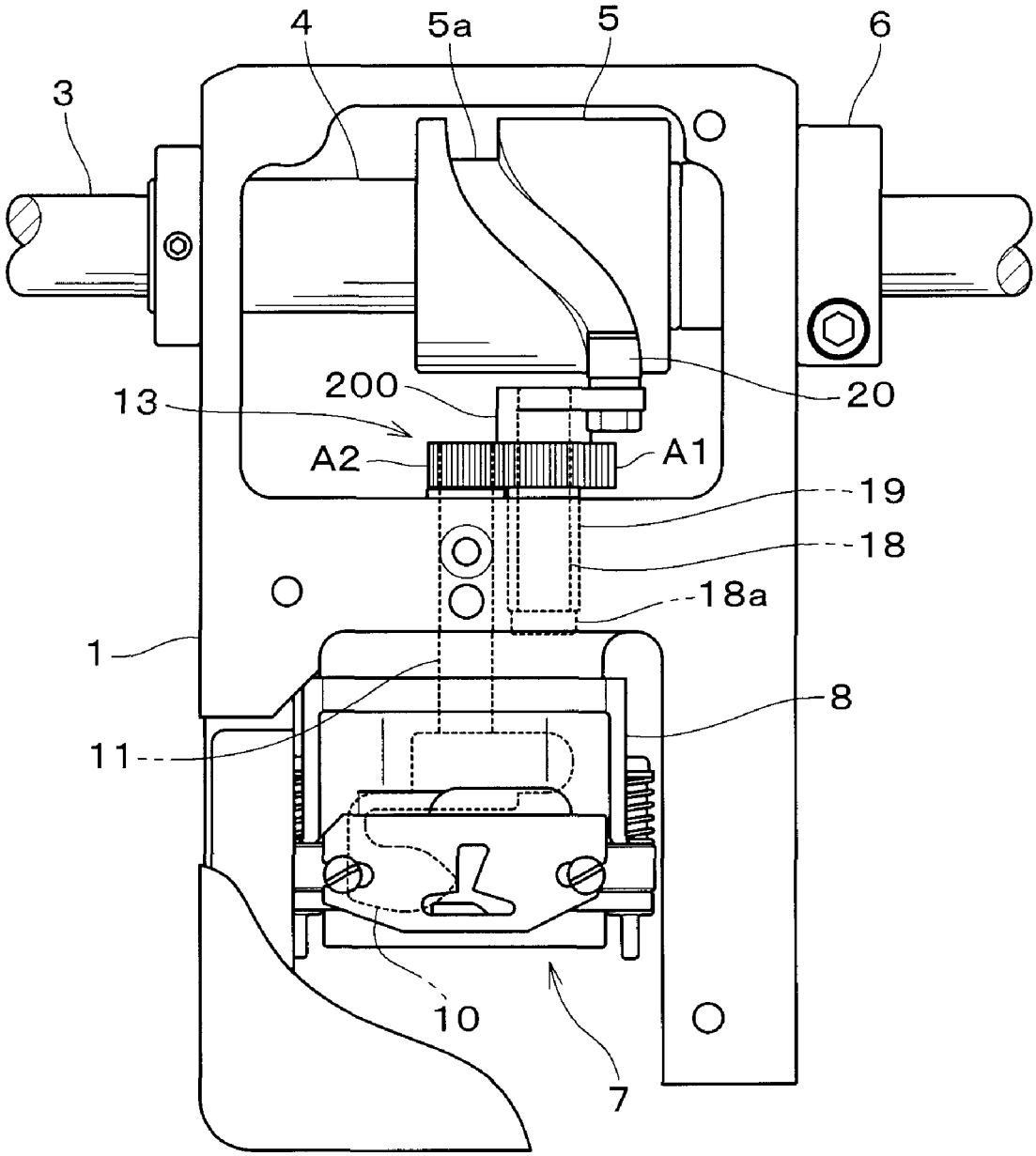
FIG. 2 is a plan view of the rotary hook drive device of FIG. 1.

FIG. 1 is a front view of a rotary hook drive device for a sewing machine according to a first embodiment of the present invention, and FIG. 2 is a plan view of the rotary hook drive device of FIG. 1. Rotary hook support member 1 is fixed to a portion of a machine frame 2 located under a sewing head (not shown) of the sewing machine. Drive shaft 3 drivable to rotate in one direction extends through the rotary hook support member 1. Cylindrical grooved cam 5 is mounted on the drive shaft 3 via a sleeve 4 within the rotary hook support member 1, and the cylindrical grooved cam 5 is fixed to the sleeve 4. The sleeve 4 is fixed to the drive shaft 3 in such a manner that its mounted position relative to the outer periphery of the cylindrical grooved cam 5 is adjustable via a split collar 6. As well known in the art, the drive shaft 3 rotates in interlocked relation to rotation of the main shaft of the sewing machine.

Semi rotary hook 7 is provided on the rotary hook support member 1. The semi rotary hook 7, which is of the conventionally-known construction, includes an outer rotary hook 8, an inner rotary hook 9 and a driver 10. The outer rotary hook 8 is fixed to the rotary hook support member 1, and the inner rotary hook 9 is pivotably supported on the outer rotary hook 8. The driver 10 is fixed to the distal end of a rotary hook shaft 11 that is rotatably supported by the outer rotary hook 8. Bobbin case 12, having accommodated therein a bobbin on which is wound a lower thread, is removably set in the semi rotary hook 7.

Figure 3:
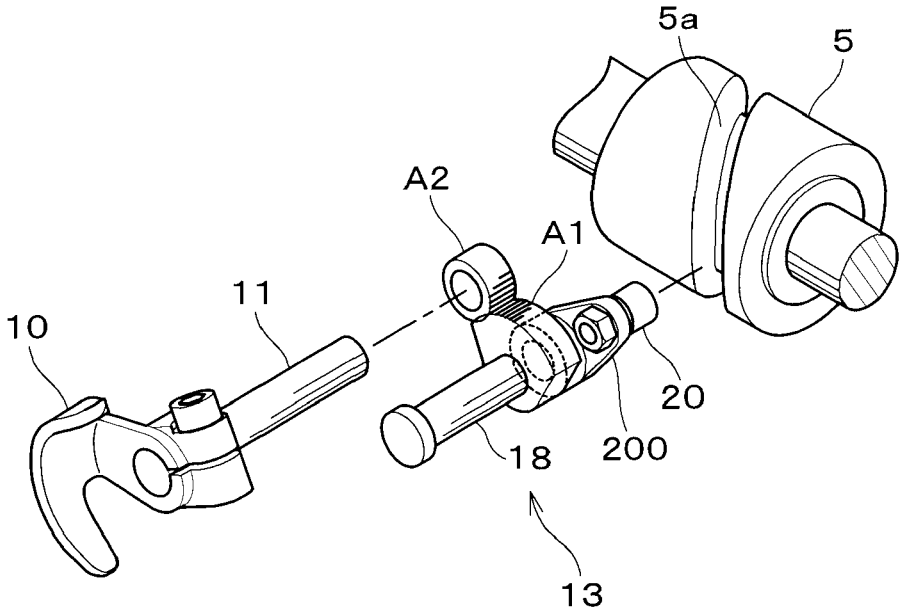
FIG. 3 is an exploded perspective view of a transmission mechanism employed in the first embodiment.
Figure 4:
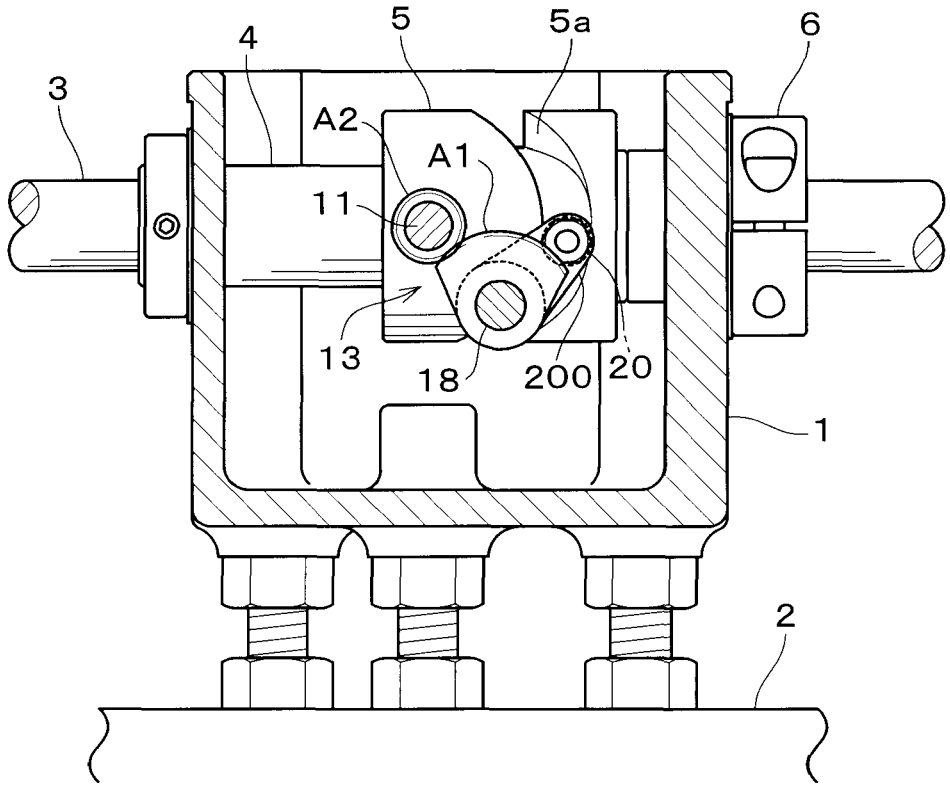
FIG. 4 is a front sectional view of the transmission mechanism employed in the first embodiment.

Transmission mechanism 13 for pivoting the driver 10 of the semi rotary hook 7 in response to rotation, in one direction, of the cylindrical grooved cam 5, is provided in front of the cylindrical grooved cam 5. FIG. 3 is an exploded perspective view of the transmission mechanism 13, and FIG. 4 is a front sectional view of the transmission mechanism 13. As clearly seen from these figures, the driver 10 is fixed to the distal end of the rotary hook shaft 11, a driven gear A2 is mounted coaxially on the rear end of the rotary hook shaft 11 and held in meshing engagement with a sector driving gear A1 fixedly mounted on a support shaft 18. Interlocking arm 200 is fixed to an axial end portion of the support shaft 18 in contact with the rear surface of the sector driving gear A1, and a roller 20, which is a cam follower, is supported on a free end portion of the interlocking arm 200. The cam follower 20 is fitted in a groove portion 5*a* of the cylindrical grooved cam 5. Thus, as the cylindrical grooved cam 5 is driven to rotate in the one direction together with the drive shaft 3, the roller 20 pivots about the support shaft 18 and the driving gear A1 too reciprocatively pivots (i.e., makes reciprocative pivoting movement) about the support shaft 18. Thus, the driven gear A2 held in meshing engagement with the driving gear A1 reciprocatively pivots, in response to which the driver 10 pivots together with the rotary hook shaft 11 so that the semi rotary hook 7 reciprocatively pivots within a predetermined angular range.

As the driver 10 of the semi rotary hook 7 makes one reciprocative pivoting movement within the predetermined angular range in response to one rotation of the cylindrical grooved cam 5, sewing operation is performed in the well-known manner through a combination of the pivoting movement of the semi rotary hook 7 (driver 10) and up-and-down movement of a sewing needle (not shown). Specifically, in response to rotation of the cylindrical grooved cam 5, the driving gear A1 reciprocatively pivots within an angular range of about 90°, so that the driven gear A2 (namely, the rotary hook shaft 11 and semi rotary hook 7) reciprocatively pivots within an angular range of about 220°.

Second Embodiment

Figure 5:
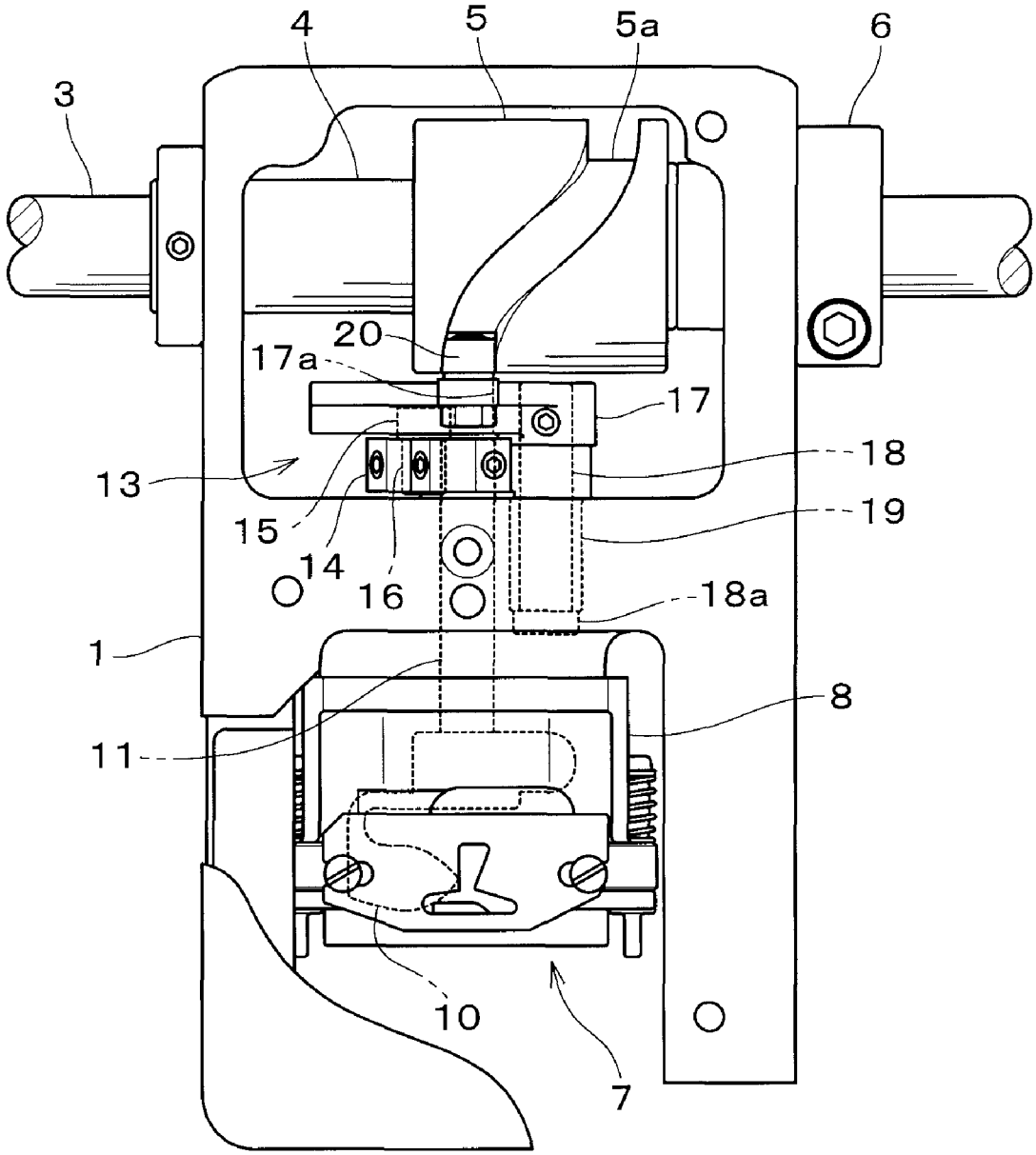
FIG. 5 is a plan view of a rotary hook drive device according to a second embodiment of the present invention.
Figure 6:
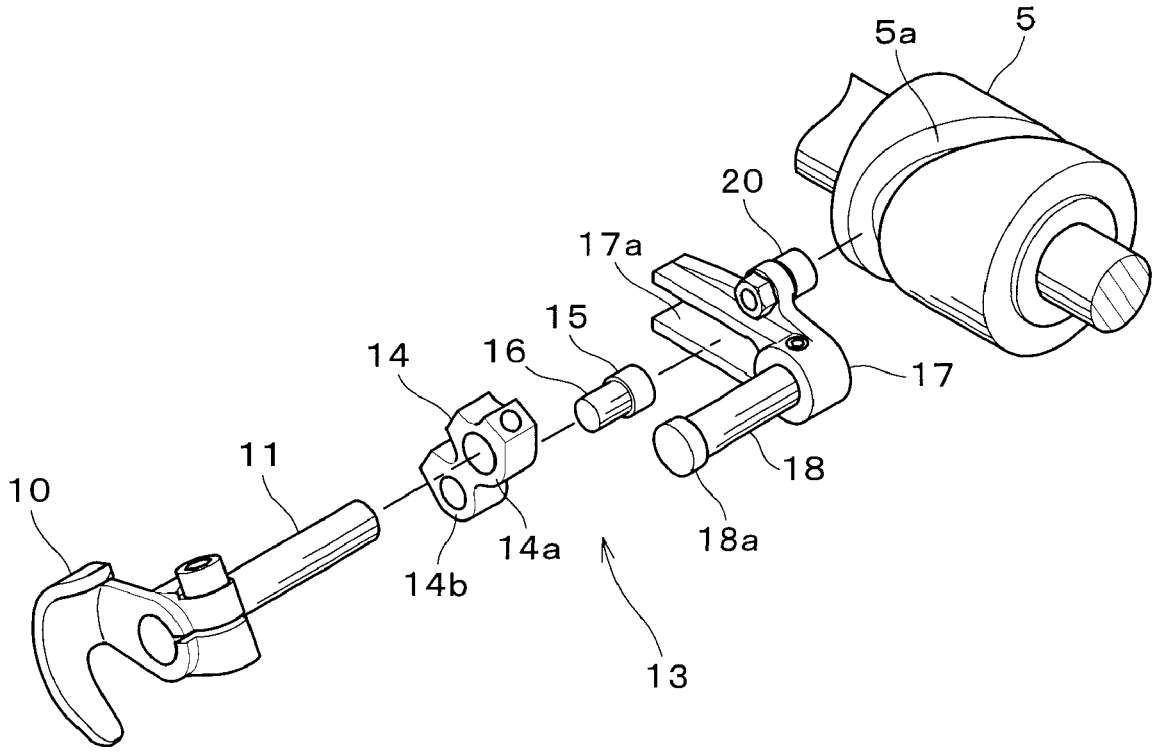
FIG. 6 is an exploded perspective view of a transmission mechanism employed in the second embodiment.
Figure 7:
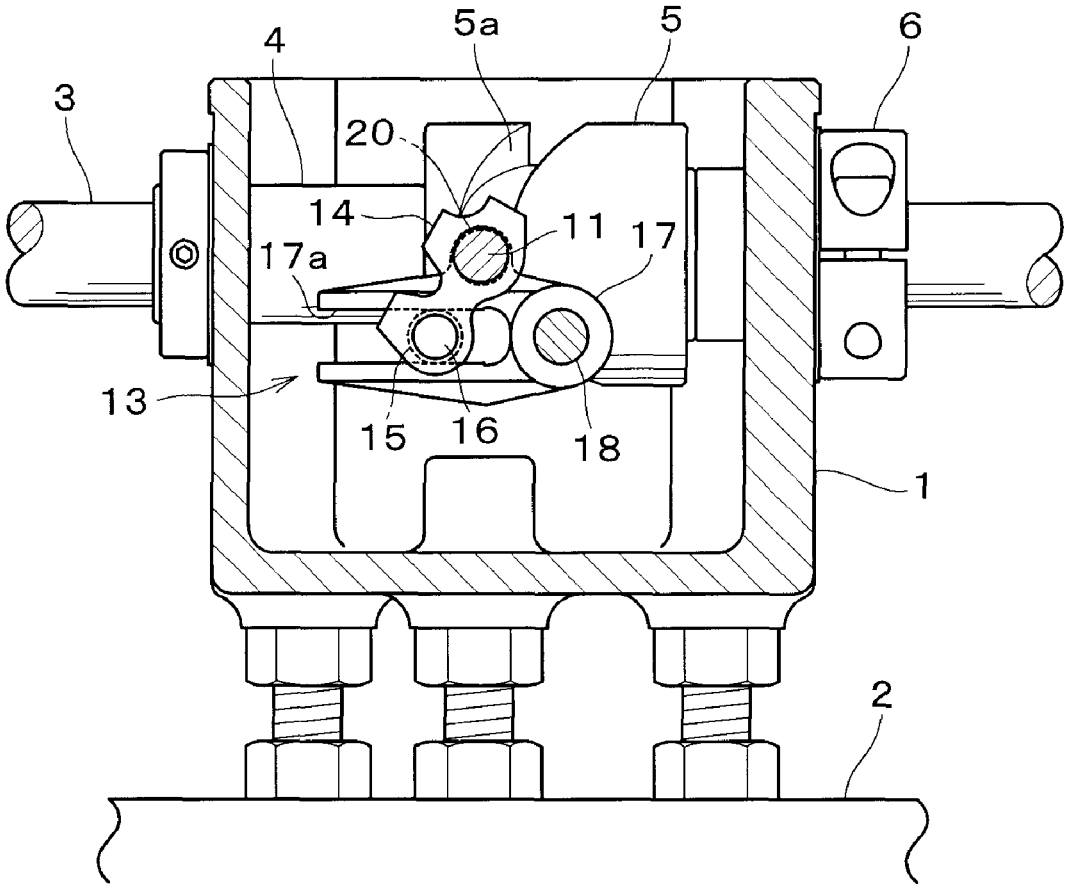
FIG. 7 is a front sectional view of the transmission mechanism employed in the second embodiment.

FIG. 5 is a plan view of a rotary hook drive device according to a second embodiment of the present invention, FIG. 6 is an exploded perspective view of a transmission mechanism employed in the second embodiment, and FIG. 7 is a front sectional view of the transmission mechanism in the second embodiment. The transmission mechanism 13 in the second embodiment is generally similar to the transmission mechanism 13 in the first embodiment, except that the transmission mechanism 13 comprises (or is constructed as) a link mechanism including a pivoting lever (or pivoting member) 14 and a driving lever (or driving member) 17 in place of the gear-based construction of the first embodiment including the gears A1 and A2. Similar elements to those in the first embodiment are indicated by the same reference numerals and characters as used for the first embodiment and will not be described here to avoid unnecessary duplication.

The transmission mechanism 13 constructed as the link mechanism includes the pivoting lever (or pivoting member) 14 fixed to a rear end portion of the rotary hook shaft 11, and the driving lever (or driving member) 17 fixed to the support shaft 18. More specifically, the pivoting lever 14 is fixed at one end portion 14*a* to the rear end portion of the rotary hook shaft 11, and the pivoting lever 14, rotary hook shaft 11 and driver 10 rotate (pivot) together. Pin 16 having a roller 15 rotatably mounted thereon is fixed to another end portion 14*b* of the pivoting lever 14. The roller 15 fits in a fitting space 17*a* defined by a fork-shape or bifurcated portion of the driving lever 17, to thereby operatively connect the pivoting lever 14 to the driving lever 17. The driving lever 17 is fixed to the support shaft 18, and the support shaft 18 is rotatably supported within a sleeve 19 (FIG. 5) that is in turn fixed to the rotary hook support member 1. Position, in a front-rear direction, of the support shaft 18 is restricted by its head portion 18*a* and the driving lever 17 fixed to its distal end. The roller 20, which is a cam follower, is fixedly mounted on an upper projection of the driving lever 17, and the roller 20 is fitted in the groove portion 5*a* of the cylindrical grooved cam 5. Thus, as the cylindrical grooved cam 5 is driven to rotate in one direction together with the drive shaft 3, the roller or cam follower 20 reciprocatively moves (or makes reciprocative movement) so that the driving lever 17 having the roller 20 fixed thereto pivots about the support shaft 18. As the lever 17 pivots, the pivoting lever 14, connected to the lever 17 via the fitting space 17*a* and roller 15 fitted in the space 17*a*, pivots, so that the rotary hook shaft 11 and driver 10 pivot together with the pivoting lever 14 and thus the semi rotary hook 7 reciprocatively pivots within a predetermined angular range.

Other Embodiments

The rotary hook drive device of the present invention is applicable not only to single-head sewing machines having only one sewing head, but also to multi-head sewing machines having a plurality of sewing heads. As one embodiment where the rotary hook drive device of the present invention is applied to a multi-head sewing machine, the aforementioned construction of each of the embodiments of the rotary hook drive device, including the cylindrical grooved cam 5, cam follower (roller 20) and transmission mechanism 13, may be provided per each of the rotary hooks. Further, as another embodiment where the rotary hook drive device of the present invention is applied to a multi-head sewing machine, the transmission mechanism 13 may be provided per each of the rotary hooks, and there may also be provided a single common cylindrical grooved cam 5 for the plurality of rotary hooks, and an interlocking mechanism for distributing the movement of the cam follower (roller 20), moving along the common cylindrical grooved cam 5, to the transmission mechanisms 13 of the shafts 11 of the individual rotary hooks as reciprocative pivoting movement.

According to the above-described present invention, the semi rotary hook is pivoted through the simple construction comprising a combination of the cylindrical grooved cam, cam follower and transmission mechanism (one set of gears) or a combination of the cylindrical grooved cam, cam follower and link mechanism. As a result, the present invention can not only effectively reduce the number of necessary component parts and the necessary cost, but also reduce the load on the drive shaft, and thus, it is well suited for high-speed operation.

The present disclosure relates to subject matter contained in Japanese Patent Application No. 2008-161718, filed on Jun. 20, 2008, the disclosure of which is expressly incorporated herein by reference in its entirety.

What is claimed is:

1. A rotary hook drive device for a sewing machine, comprising:

a rotary hook rotatably provided on a rotary hook support;

a cylindrical grooved cam provided on a drive shaft drivable to rotate in one direction;

a cam follower engaged in a cam groove of said cylindrical grooved cam and capable of making reciprocative movement about a support shaft in response to rotation of said cylindrical grooved cam; and a transmission mechanism that transmits the reciprocative movement of said cam follower to the rotary hook to cause the rotary hook to make reciprocative pivoting movement;

wherein said transmission mechanism comprises a link mechanism that amplifies the reciprocative movement of said cam follower and transmits the amplified reciprocative movement to a rotary hook shaft of the rotary hook.

2. The rotary hook drive device as claimed in claim 1 wherein said link mechanism includes:

a driving member pivotably supported by the rotary hook support via the support shaft; and a pivoting member connected to said driving member and fixed to the rotary hook shaft, wherein the rotary hook shaft is pivotable within a predetermined angular range of the rotary hook shaft as said pivoting member pivots in response to pivoting movement of said driving member.

3. A multi-head sewing machine comprising:

a plurality of sewing heads; and a plurality of rotary hook drive mechanisms provided in corresponding relation to said sewing heads;

wherein each of said plurality of rotary hook drive mechanisms includes the rotary hook drive device, each of which includes a rotary hook rotatably provided on a rotary hook support, a cylindrical grooved cam provided on a drive shaft drivable to rotate in one direction, a cam follower engaged in a cam groove of said cylindrical grooved cam and capable of making reciprocative movement about a support shaft in response to rotation of said cylindrical grooved cam, and a transmission mechanism that transmits the reciprocative movement of said cam follower to the rotary hook to cause the rotary hook to make reciprocative pivoting movement; and wherein the drive shaft is provided in common to individual ones of the rotary hooks.

4. A multi-head sewing machine including a plurality of sewing heads, and a plurality of rotary hooks provided in corresponding relation to the sewing heads and pivotably supported by respective rotary hook supports, said multi-head sewing machine comprising:

a plurality of transmission mechanisms provided in corresponding relation to the plurality of rotary hooks;

a cylindrical grooved cam provided on a drive shaft drivable to rotate in one direction;

a cam follower engaged in a cam groove of said cylindrical grooved cam and capable of making reciprocative movement about a support shaft in response to rotation of said cylindrical grooved cam; and an interlocking mechanism that distributes the reciprocative movement of said cam follower to said plurality of transmission mechanisms corresponding to the plurality of rotary hooks, wherein the reciprocative movement of said cam follower is distributed to the plurality of rotary hooks, via said interlocking mechanism and said transmission mechanisms, to thereby cause the plurality of rotary hooks to make reciprocative movement.

* * * * *